US011885536B2

(12) United States Patent
Ko et al.

(10) Patent No.: US 11,885,536 B2
(45) Date of Patent: Jan. 30, 2024

(54) CLOTHES TREATING APPARATUS AND METHOD FOR CONTROLLING SAME

(71) Applicant: LG ELECTRONICS INC., Seoul (KR)

(72) Inventors: Cheolsoo Ko, Seoul (KR); Hyojun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 85 days.

(21) Appl. No.: 16/467,361

(22) PCT Filed: Dec. 7, 2017

(86) PCT No.: PCT/KR2017/014277

§ 371 (c)(1),
(2) Date: Jun. 6, 2019

(87) PCT Pub. No.: WO2018/106035

PCT Pub. Date: Jun. 14, 2018

(65) Prior Publication Data

US 2019/0330790 A1 Oct. 31, 2019

(30) Foreign Application Priority Data

Dec. 7, 2016 (KR) ..... 10-2016-0165955

(51) Int. Cl.
*D06F 58/04* (2006.01)
*D06F 58/24* (2006.01)
(Continued)

(52) U.S. Cl.
CPC ..... *F25B 31/002* (2013.01); *D06F 58/38* (2020.02); *D06F 25/00* (2013.01); *D06F 58/04* (2013.01);
(Continued)

(58) Field of Classification Search
CPC ..... D06F 33/43; D06F 33/69; D06F 58/45; D06F 58/206; D06F 2103/50;
(Continued)

(56) References Cited

U.S. PATENT DOCUMENTS

2010/0024137 A1 2/2010 Im et al.
2012/0186305 A1* 7/2012 Taniguchi ..... D06F 58/30 68/19
(Continued)

FOREIGN PATENT DOCUMENTS

JP H10-157449 6/1998
JP 2007-061264 3/2007
(Continued)

OTHER PUBLICATIONS

JP2013085793—Machine Translation (Year: 2013).*
(Continued)

*Primary Examiner* — Marc Lorenzi
(74) *Attorney, Agent, or Firm* — KED & ASSOCIATES, LLP

(57) ABSTRACT

The present invention relates to a method for controlling a clothes treating apparatus, the method comprising: a circulation step of circulating air by operating a fan; a heat exchange step of opening a refrigerant pipe by controlling an expansion valve, and circulating a refrigerant by operating a compressor; a circulation termination step of terminating the operation of the fan when the dryness level of clothes stored in a receiving part reaches a predetermined reference dryness level or when the elapsed time of the heat exchange step reaches a predetermined reference time; and a return step of closing the refrigerant pipe by controlling the expansion valve, and returning the refrigerant and lubricant in the refrigerant pipe to the compressor by operating the compressor.

9 Claims, 4 Drawing Sheets

(51) Int. Cl.

| | |
|---|---|
| ***F25B 31/00*** | (2006.01) |
| ***D06F 58/38*** | (2020.01) |
| *D06F 103/08* | (2020.01) |
| *D06F 103/30* | (2020.01) |
| *D06F 103/38* | (2020.01) |
| *D06F 103/42* | (2020.01) |
| *D06F 103/44* | (2020.01) |
| *D06F 103/50* | (2020.01) |
| *D06F 103/54* | (2020.01) |
| *D06F 58/50* | (2020.01) |
| *D06F 105/26* | (2020.01) |
| *D06F 105/30* | (2020.01) |
| *D06F 105/34* | (2020.01) |
| *D06F 105/52* | (2020.01) |
| *D06F 105/62* | (2020.01) |
| *D06F 25/00* | (2006.01) |
| *D06F 58/20* | (2006.01) |
| *D06F 58/22* | (2006.01) |

(52) U.S. Cl.
CPC ..... *D06F 58/20* (2013.01); *D06F 58/206* (2013.01); *D06F 58/22* (2013.01); *D06F 58/24* (2013.01); *D06F 58/50* (2020.02); *D06F 2103/08* (2020.02); *D06F 2103/30* (2020.02); *D06F 2103/38* (2020.02); *D06F 2103/42* (2020.02); *D06F 2103/44* (2020.02); *D06F 2103/50* (2020.02); *D06F 2103/54* (2020.02); *D06F 2105/26* (2020.02); *D06F 2105/30* (2020.02); *D06F 2105/34* (2020.02); *D06F 2105/52* (2020.02); *D06F 2105/62* (2020.02)

(58) Field of Classification Search
CPC ..... D06F 2103/54; D06F 2105/26; D06F 2105/34; D06F 2105/52; D06F 2105/54
See application file for complete search history.

(56) References Cited

U.S. PATENT DOCUMENTS

| | | | | |
|---|---|---|---|---|
| 2013/0232813 | A1* | 9/2013 | Heo | D06F 58/48 34/515 |
| 2015/0121718 | A1* | 5/2015 | Huang | D06F 58/30 34/476 |
| 2016/0047081 | A1* | 2/2016 | Lee | D06F 58/206 34/427 |
| 2016/0115636 | A1* | 4/2016 | Kim | D06F 39/088 68/18 F |

FOREIGN PATENT DOCUMENTS

| | | | | |
|---|---|---|---|---|
| JP | 4046828 | | 2/2008 | |
| JP | 2008-289596 | | 12/2008 | |
| JP | 2009-022346 | | 2/2009 | |
| JP | 2009-300055 | | 12/2009 | |
| JP | 2013-085680 | | 5/2013 | |
| JP | 2013085793 | A * | 5/2013 | |
| KR | 10-1994-0009437 | | 5/1994 | |
| KR | 10-2000-0038556 | | 7/2000 | |
| KR | 10-2005-0061876 | | 6/2005 | |
| KR | 10-2007-0076853 | | 7/2007 | |
| KR | 10-2008-0103856 | | 11/2008 | |
| KR | 10-2010-0046694 | | 5/2010 | |
| KR | 10-2010-0129242 | | 12/2010 | |
| KR | 10-2011-0078379 | | 7/2011 | |
| KR | 10-2013-0114780 | | 10/2013 | |
| WO | WO-2015165487 | A1 * | 11/2015 | D06F 58/24 |

OTHER PUBLICATIONS

International Search Report (English Translation) dated Mar. 30, 2019 issued in Application No. PCT/KR2017/014277.
Written Opinion (English Translation) dated Mar. 30, 2019 issued in Application No. PCT/KR2017/014277.
European Search Report dated May 15, 2020 issued in EP Application No. 17878332.0.
Korean Office Action dated Aug. 18, 2023, issued in Application No. 10-2016-0165955.

* cited by examiner

CLOTHES TREATING APPARATUS AND METHOD FOR CONTROLLING SAME

CROSS-REFERENCE TO RELATED PATENT APPLICATIONS

This application is a U.S. National Stage Application under 35 U.S.C. § 371 of PCT Application No. PCT/KR2017/014277, filed Dec. 7, 2017, which claims priority to Korean Patent Application No. 10-2016-0165955, filed Dec. 7, 2016, whose entire disclosures are hereby incorporated by reference.

TECHNICAL FIELD

The present invention relates to a clothes treating apparatus with a heat pump, and a method of controlling the clothes treating apparatus.

BACKGROUND ART

A clothes treating apparatus for drying clothes is typically provided with a container for storing clothes and a hot air supply unit for supplying heated air. Some conventional clothes treating apparatus uses a heat pump as a hot air supply unit. The heat pump is a means for dehumidifying air discharged from a container and heating the dehumidified air by circulating refrigerant along an evaporator, a compressor, a condenser, and an expansion valve.

The compressor in the heat pump is a means for compressing the refrigerant discharged from the evaporator and supplying the compressed refrigerant to the condenser, and the refrigerant is circulated along a refrigerant pipe by the compressor. The compressor is either a reciprocating compressor or a rotary compressor. In both cases, only when lubricant is supplied to a compression chamber in the compressor, the durability of the compressor may be maintained. Accordingly, the heat pump having the compressor in which the lubricant is supplied to the compression chamber for compressing the refrigerant suffers from discharge of the lubricant together with the refrigerant into the refrigerant pipe.

The discharge of the refrigerant from the compressor into the refrigerant pipe leads to a decrease in the amount of the lubricant stored in the compressor, thereby decreasing the durability of the compressor and the efficiency of heat exchange between the refrigerant and air in the evaporator or the condenser.

DISCLOSURE

Technical Problem

An aspect of the present invention devised to solve the conventional problem is to provide a clothes treating apparatus which minimizes the amount of residual lubricant in a refrigerant pipe, and a method of controlling the clothes treating apparatus.

Technical Solution

In an aspect of the present invention, there is provided a method of controlling a clothes treating apparatus including a container configured to accommodate clothes therein, a duct forming a passage for circulating air inside the container therethrough, a fan provided in the duct, a refrigerant pipe forming a refrigerant circulation passage, an evaporator configured to evaporate refrigerant by exchanging heat with air, a condenser configured to condense the refrigerant by exchanging heat with air passed through the evaporator, a compressor configured to compress the refrigerant discharged from the evaporator and transferring the compressed refrigerant to the condenser, and an expansion valve configured to open and close the refrigerant pipe. The method includes a circulation step of circulating air by operating the fan, a heat exchange step of opening the refrigerant pipe by controlling the expansion valve, and circulating the refrigerant by operating the compressor, a circulation termination step of terminating the operation of the fan, if a dryness level of clothes stored in the container has reached a predetermined reference dryness level or a progress time of the heat exchange step has reached a predetermined reference time, and a retrieval step of closing the refrigerant pipe by controlling the expansion valve, and retrieving the refrigerant and lubricant from the refrigerant pipe to the compressor by operating the compressor.

The compressor may include a compression unit configured to make rotating motion inside the compressor.

A number of revolutions of the compression unit may be set to be less in the retrieval step than in the heat exchange step.

The compressor may include a compression unit configured to make a linear reciprocating motion inside the compressor.

A reciprocating cycle of the compression unit may be set to be longer in the retrieval step than in the heat exchange step.

The method of controlling a clothes treating apparatus according to the present invention may further include a cooling step of dropping a temperature of the clothes stored in the container by operating the fan, the cooling step being initiated after completion of the retrieval step.

The method of controlling a clothes treating apparatus according to the present invention may further include a residual amount determination step of determining whether the amount of a foreign material remaining in a filter filtering air introduced into the duct is equal to or larger than a predetermined reference amount, performed during the circulation step in progress, a fan operation termination step of, if the amount of the foreign material remaining in the filter is equal to or larger than the predetermined reference amount, terminating operation of the filter, and a filter cleaning step of operating a filter cleaning unit configured to spray water onto the filter, after the operation of the fan is terminated.

The method of controlling a clothes treating apparatus according to the present invention may further include an interim retrieval step of, when the rotation of the fan is terminated in the fan operation termination step, closing the refrigerant pipe by controlling the expansion valve, and retrieving the refrigerant and lubricant from the refrigerant pipe to the compressor by operating the compressor.

A progress time of the interim retrieval step may be set to be equal to or shorter than a progress time of the filter cleaning step.

The method of controlling a clothes treating apparatus according to the present invention may further include a water film removal step of rotating the fan at a larger number of revolutions than a number of revolutions of the fan set in the circulation step, after completing the filter cleaning step.

If a progress time of the heat exchange step has not reached a reference time or a dryness level of the clothes measured after completion of the water film removal step has not reached the reference dryness level, the circulation step and the heat exchange step may be resumed after the completion of the water film removal step.

The fan may include an impeller provided inside the duct and a motor configured to rotate the impeller, a number of revolutions of the impeller may be maintained to be a predetermined reference number of revolutions in the circulation step, and if the amount of current supplied to the motor to maintain the number of revolutions of the impeller to be the reference number of revolutions in the circulation step is equal to or less than a reference current amount, it may be determined that the amount of the foreign material remaining in the filer is equal to or larger than the reference amount in the residual amount determination step.

The container may include a tub configured to store water therein and a drum rotatably provided inside the tub and configured to store clothes therein, and if a pressure output from a pressure sensing unit configured to sense the internal pressure of the tub is equal to higher than a predetermined reference pressure, it may be determined that the amount of the foreign material remaining in the filer is equal to or larger than the reference amount in the residual amount determination step.

If a temperature of the refrigerant discharged from the compressor is equal to or higher than a predetermined reference temperature, it may be determined that the amount of the foreign material remaining in the filer is equal to or larger than the reference amount in the residual amount determination step.

In another aspect of the present invention, a clothes treating apparatus includes a container configured to accommodate clothes therein, a duct forming a passage for circulating air inside the container therethrough, a fan provided in the duct, a heat pump including a refrigerant pipe forming a refrigerant circulation passage, an evaporator configured to evaporate refrigerant by exchanging heat with air introduced into the duct, a condenser configured to condense the refrigerant by exchanging heat with air passed through the evaporator, a compressor configured to compress the refrigerant discharged from the evaporator and transferring the compressed refrigerant to the condenser, and an expansion valve configured to open and close the refrigerant pipe, and a controller configured to control the fan and the heat pump.

If the controller determines that operation of the fan is completed, the controller is configured to close the refrigerant pipe by controlling the expansion value, and operate the compressor to retrieve the refrigerant and lubricant from the refrigerant pipe to the compressor.

The clothes treating apparatus according to the present invention may further include a sensor provided inside the container or the duct, to measure a dryness level of the clothes stored in the container.

If the controller determines that the dryness level of the clothes stored in the container has reached a predetermined reference dryness level, the controller may be configured to terminate the operation of the fan.

The clothes treating apparatus according to the present invention may further include a filter configured to filter air introduced into the duct.

If the controller determines that the amount of a foreign material remaining in the filter is equal to or larger than a predetermined reference amount, the controller may be configured to terminate the operation of the fan.

The clothes treating apparatus may further include a filter cleaning unit configured to clean the foreign material remaining in the filter.

If the controller determines that the amount of the foreign material remaining in the filter is equal to or larger than the predetermined reference amount and terminates the operation of the filter, the controller may be configured to control the filter cleaning unit to clean the filter.

Advantageous Effects

The present invention has the effect of providing a clothes treating apparatus which minimizes the amount of residual lubricant in a refrigerant pipe, and a method of controlling the clothes treating apparatus.

BEST MODE FOR CARRYING OUT THE INVENTION

Figure 1:
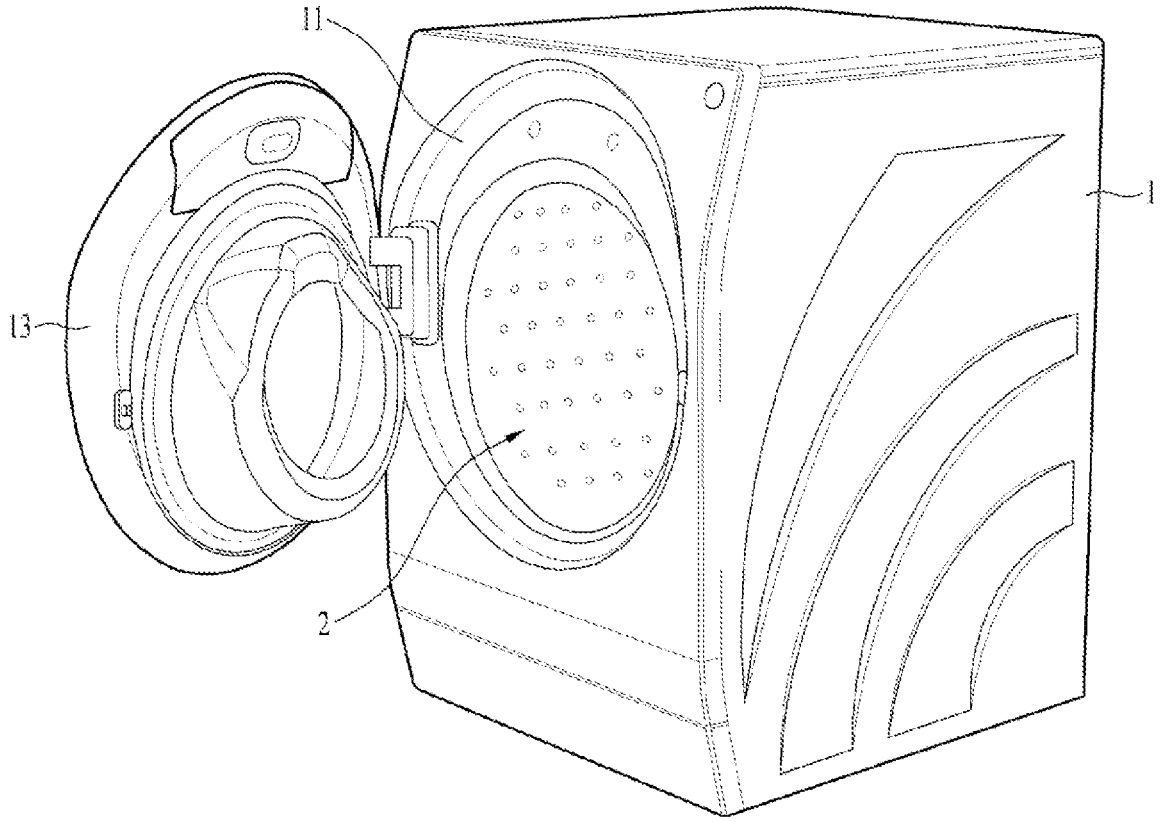
FIGS. 1 and 2 illustrate an exemplary clothes treating apparatus according to an embodiment of the present invention.

With reference to the attached drawings, a preferred embodiment of the present invention will be described below in detail. The configuration of an apparatus or a control method as described below is intended to describe an embodiment of the present invention, not limiting the scope of the present invention. Throughout the specification, like reference numerals denote the same components.

Referring to FIG. 1, a clothes treating apparatus 100 according to an embodiment of the present invention includes a cabinet 1, a container 2 disposed inside the cabinet 1 and providing a space for accommodating clothes therein, and a hot air supply unit 7, 8 and 9 supplying heated air (hot air) into the container 2.

The cabinet 1 is provided, on a front surface thereof, with an opening 11 through which clothes are put in or taken out from the container 2, and the opening 11 is opened and closed by a door 13 rotatably fixed to the cabinet 1.

Figure 2:
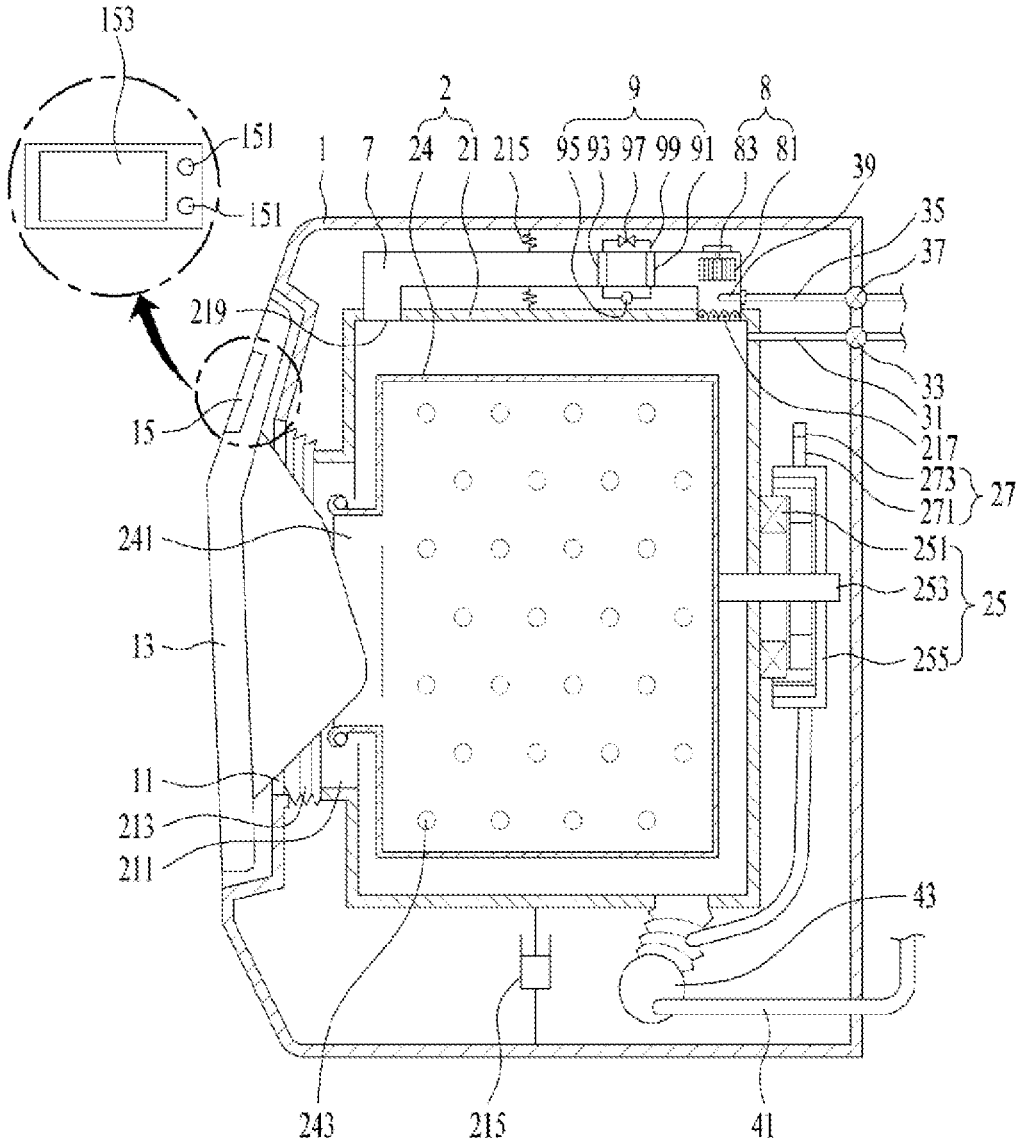

Referring to FIG. 2, the door 13 may include a control panel 15 which receives a control command from a user and displays the progress of executing the received control command. The control panel 15 may include an input unit 151 which receives a control command from the user and a display 153 which displays control commands available to the user or information about the progress of executing a user-selected control command.

If the clothes treating apparatus according to an embodiment of the present invention is implemented for clothes washing as well as clothes drying, the container 2 may include a tub 21 which is disposed inside the cabinet 1 and provides a space for storing water therein, and a drum 24 which is rotatably provided inside the tub 21 and provides a space for storing clothes therein.

The tub 21 is fixed inside the cabinet 1 through a support unit 215. The support unit 215 may include a spring and a damper which prevent transfer of vibrations generated in the tub 21 to the cabinet 1.

The tub 21 includes a tub opening 211 communicating with the opening 11, and the opening 11 is coupled to the tub opening 211 through a gasket 213. The gasket 213 is a means for preventing leakage of water stored in the tub 21 into the cabinet 1.

The tub 21 may receive water through a water supply pipe 31 and discharge water inside the tub 21 to the outside the cabinet 1 through a drain pipe 41. The water supply pipe 31 is configured to couple a water supply (not shown) residing outside the cabinet to the tub 21, and is opened or closed by means of a first valve 33 under the control of a controller (not shown). The drain pipe 41 is a passage along which the water in the tub 21 is guided to the outside of the cabinet 1. The drain pipe 41 is provided with a pump 43.

A water level in the tub 21 may be controlled through a pressure sensing unit 27. The pressure sensing unit 27 may include a communication pipe 271 communicating with the inside of the tub 21 and a pressure sensor 273 sensing an internal pressure of the communication pipe 271. FIG. 2 illustrates an example in which the communication pipe 271 communicates with the inside of the tub 21 through the drain pipe 41. In this case, as the water level in the tub 21 rises, the internal pressure of the communication pipe 271 may also increase. Therefore, the controller may determine the water level in the tub 21 based on data (voltage or current) output from the pressure sensor 273.

The drum 24 includes a drum opening 241 communicating with the opening 11 and the tub opening 211, and a plurality of through holes 243 communicating the inside of the drum 24 with the inside of the tub 21.

The drum 24 is rotated by a drum drive unit 25 inside the cabinet 1. The drum drive unit 25 may include a stator 251 which is fixed to the rear surface of the tub 21, to generate a rotating field, upon receipt of current, a rotor 255 which is rotated by the rotating field, and a rotation shaft 253 which couples the drum 24 to the rotor 255.

The hot air supply unit 7, 8 and 9 may include a duct 7 positioned outside the tub 21 and forming an air circulation passage, a fan 8 disposed inside the duct 7 and blowing air in the tub 21, and a heat pump 9 dehumidifying and heating air introduced into the duct 7.

The duct 7 has one end coupled to an outlet penetrating through the tub 21 and the other end coupled to an inlet 219 penetrating through the tub 21, and a filter 217 may be provided in the outlet, to filter the air introduced into the duct 7.

When the filter 217 is provided in the outlet of the tub 21, the clothes treating apparatus 100 according to an embodiment of the present invention may further include a filter cleaning unit 35 and 37 for cleaning the filter 217. The filter cleaning unit 35 and 37 may include a sprayer 39 fixed inside the duct 7, a second water supply pipe 35 which couples the sprayer 39 to the water supply (not shown), and a second valve 37 which opens and closes the second water supply pipe 35 under the control of the controller.

The fan 8 may include an impeller 81 which is rotatably disposed inside the duct 7 and a fan motor 83 which is fixed to the exterior of the duct 7 and rotates the impeller 81.

The heat pump 9 may include a refrigerant pipe 99 which forms a refrigerant circulation passage, an evaporator 91 which is positioned inside the duct 7 and fixed to the refrigerant pipe 99, a condenser 93 which is positioned inside the duct 7 and fixed to the refrigerant pipe 99, a compressor 95 which compresses refrigerant passed through the evaporator 91 and transfers the compressed refrigerant to the condenser 93, and an expansion valve 97 which opens or closes the refrigerant pipe 99 (controls the flow rate of the refrigerant) and thus controls the pressure of the refrigerant discharged from the condenser 93.

Since the evaporator 91 absorbs heat from the air introduced into the duct 7, the refrigerant passed through the evaporator 91 may evaporate inside the refrigerant pipe 99, and since the condenser 93 emits heat to the air passed through the evaporator 91, the refrigerant passed through the condenser 93 may be condensed inside the refrigerant pipe 99. Therefore, the air passed through the evaporator 91 is cooled, whereas the air passed through the condenser 93 is heated.

As far as the above function can be executed, the compressor 95 may be of any type, for example, a reciprocating compressor, a rotary compressor, or a scroll compressor.

Figure 3:
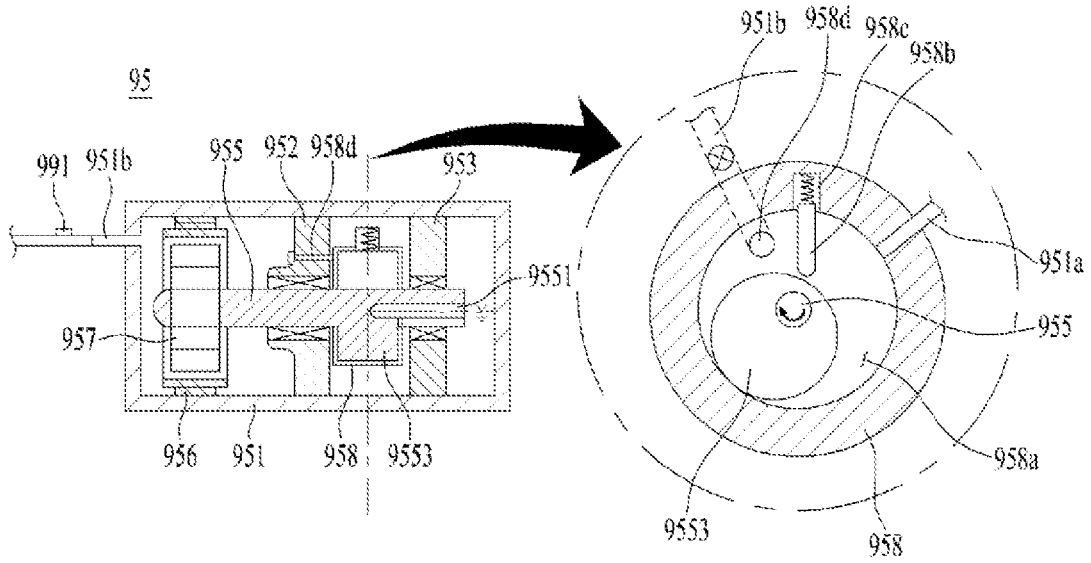
FIGS. 3 and 4 illustrate exemplary compressors.

FIG. 3 illustrates an exemplary rotary compressor. A compressor 95 illustrated in FIG. 3 may include a case 951, a shaft 955 rotatably disposed inside the case 951, a drive unit 956 and 957 rotating the shaft 955, and a compression chamber 958 disposed inside the case 951 and compressing refrigerant.

The case 951 includes an inlet 951*a* which guides the refrigerant discharged from the evaporator 91 to the compression chamber 958, and an outlet 951*b* which discharges the compressed refrigerant to the outside of the case 951.

The shaft 955 is rotatably supported inside the case 951 by a first bearing housing 952 and a second bearing housing 953 which are fixed inside the case 951. The drive unit 956 and 957 may include a stator 956 which is fixed to the case 951 and forms a rotating field and a rotor 957 which is fixed to the shaft 955 and rotates by the rotating field.

The shaft 955 is provided with a compression unit 9553 rotating eccentrically in the compression chamber 958.

The compression chamber 958 includes a chamber 958*a* fixed to the case 951 and providing a space for accommodating the compression unit 9553 therein, a partition 958*b* separating the inner space of the chamber 958*a*, a spring 958*c* providing elastic force to the partition 958*b*, and a chamber outlet 958*d* discharging the refrigerant from the chamber 958*a*.

In the compressor 95 having the above-described structure, when the refrigerant discharged from the evaporator 91 is supplied to the chamber 958*a* through the inlet 951*b*, the compression unit 9553 rotates along with the shaft 955, and the refrigerant compressed in the chamber 958*a* by the compression unit 9553 is supplied to the condenser 93 through the chamber outlet 958*d* and the outlet 951*c*.

Since the compression unit 9553 should rotate in the chamber 958*a*, a supply for supplying lubricant to the chamber 958*a* is provided in the case 951. In the illustrated case of FIG. 3, the supply is provided as a passage 9551 which is defined inside the shaft 955 and guides lubricant stored in the case 951 to the chamber 958*a*.

Figure 4:
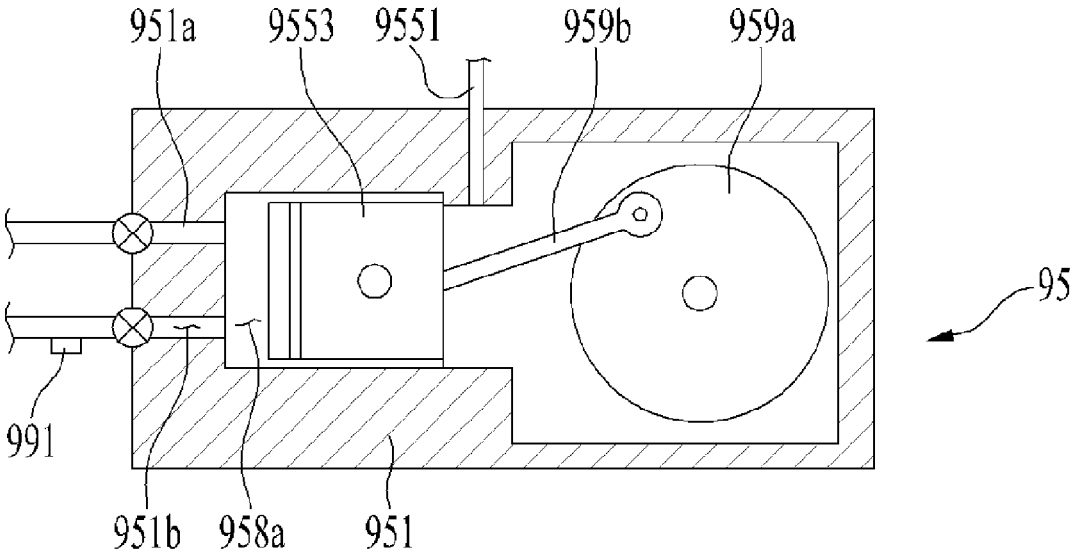

FIG. 4 illustrates an exemplary reciprocating compressor. A compressor 95 according to an embodiment of the present invention may include the case 951, the chamber 958*a* which is disposed in the case 951, receives refrigerant through the inlet 951*a*, and discharges the refrigerant through the outlet 951*b*, the compression unit 9553 which makes a linear reciprocating motion in the chamber 958*a*, a rotating plate 959*a* which is rotated by a motor, and a link 959*b* which couples the rotating plate 959*a* to the compression unit 9553 and converts a rotational motion to a linear motion. The compressor 95 according to this embodiment also includes the supply 9551 supplying lubricant to the chamber 958*a*. In the illustrated case of FIG. 4, the supply 9551 is a passage coupled to the chamber 958*a*, penetrating through the case 951.

As described above, when the compression unit 9553 is configured to make a rotational motion or a linear reciprocating motion in the chamber 958*a*, the supply 9551 supplying lubricant to the chamber 958*a* is essential to the compressor 95. If the lubricant is supplied to the chamber 958*a*, the resulting reduced friction between the compression unit 9553 and the chamber 958*a* may increase the durability of the compressor 95. Despite this benefit, the lubricant may be circulated along with the refrigerant compressed in the chamber 958*a* along the refrigerant pipe 99.

If the lubricant is discharged to the outside of the compressor 95 and circulated along the refrigerant pipe 99, the amount of the lubricant stored in the case 951 is reduced, thereby decreasing the efficiency of heat exchange between the refrigerant and air in the evaporator 91 or the condenser 93 as well as the durability of the compression unit 9553 and the chamber 958*a*. This problem may be more frequent, when the compressor 95 is disposed in parallel to the bottom surface of the cabinet.

Figure 5:
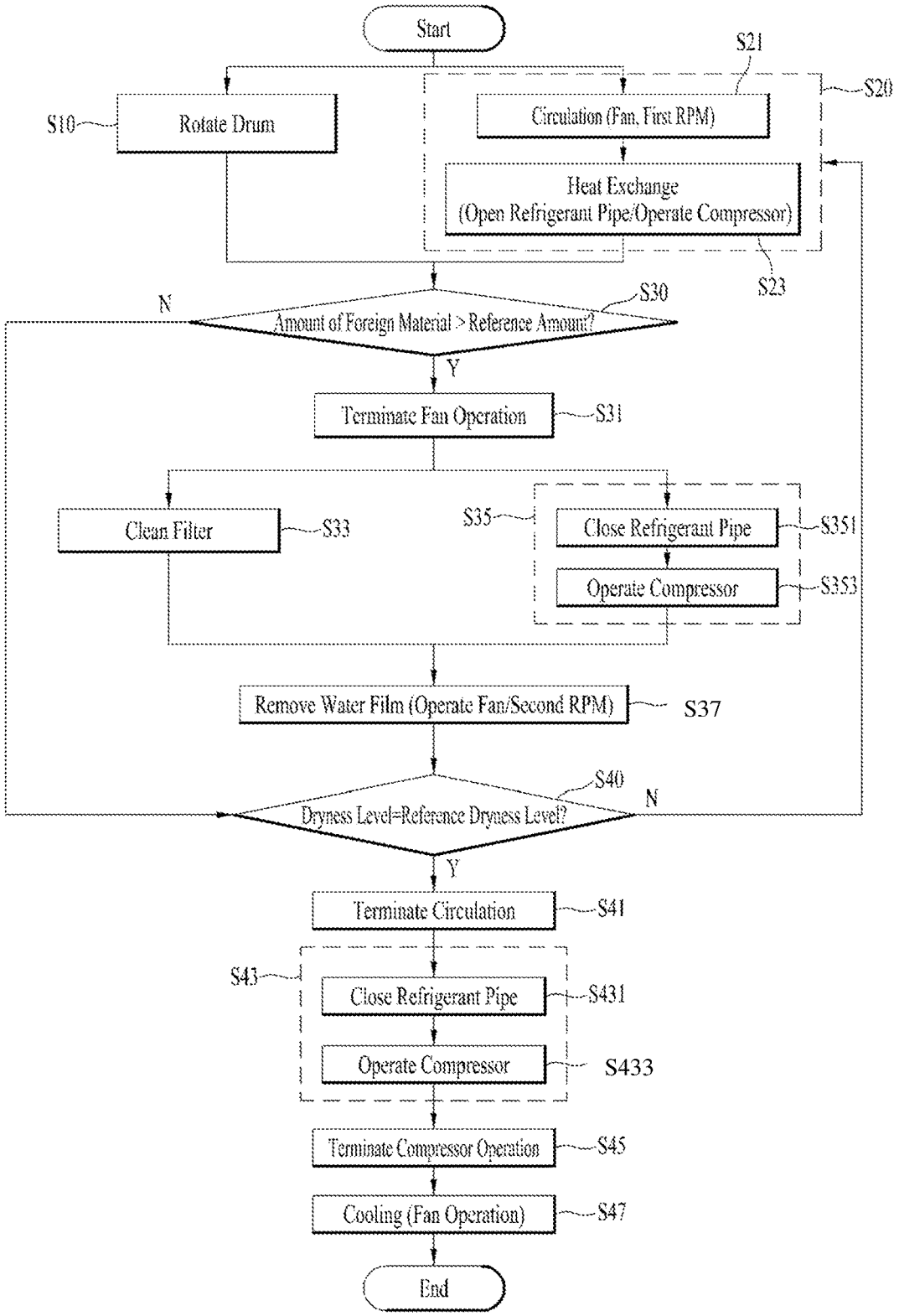
FIG. 5 is a flowchart illustrating a method of controlling a clothes treating apparatus according to an embodiment of the present invention.

To avert the above problem, a control method according to an embodiment of the present invention may minimize the amount of residual lubricant in the refrigerant pipe 99 by a control operation illustrated in FIG. 5. Now, a description will be given of the control method according to an embodiment of the present invention in the context of the compressor illustrated in FIG. 3.

The control method according to embodiment of the present invention may include a drying step S10 and S20 of supplying hot air into the container 2, a retrieval step S43 of retrieving lubricant from the refrigerant pipe 99, which is initiated when the dryness level of clothes has reached a predetermined reference dryness level or a dry time (reference time) set before a hot air supply step starts (S40) has elapsed, and a cooling step S47 initiated after the retrieval step S43.

The drying step may include a drum rotation step S10 of rotating the drum 24 by supplying power to the stator 251 of the drum drive unit, and a hot air supply step S20 of dehumidifying and heating air introduced into the duct 7 by operating the fan 8 and the heat pump 9.

The hot air supply step S20 may include a circulation step S21 of rotating the impeller 81 by supplying power to the fan motor 83, and a heat exchange step S23 of circulating refrigerant along the refrigerant pipe 99 by controlling the expansion valve 99 and the compressor 95.

In the circulation step S21, the controller may control power supplied to the fan motor 83 such that the impeller 81 maintains a predetermined revolution per minute (RPM).

In the heat exchange state S23, the controller compresses the refrigerant introduced into the chamber 958*a* by controlling (opening) the expansion valve 99 to allow the refrigerant to move along the refrigerant pipe 99, supplying power to the stator 956 of the compressor, and thus rotating the shaft 955.

The controller may continue supplying power to the stator 251 of the drive unit to keep the drum rotation step S10 running during the hot air supply step S20 in progress. This is because stirring clothes in the drum by rotation of the drum is helpful in shortening a dry time.

When the drying step S10 and S20 starts, a step S40 of determining whether the reference time set in the drying step has elapsed or the dryness level of clothes stored in the drum has reached the reference dryness level is performed in the control method according to embodiment of the present invention.

The reference time may be configured by the controller according to the amount of the clothes stored in the drum 24 or according to the type of a control command selected on the input unit 151 by the user. In this case, the controller may determine an ending time of the drying step by checking whether the progress time of the drying step S10 and S20 has reached the reference time.

It may be sensed whether the dryness level of clothes has reached the reference dryness level, through a sensor (not shown) which is configured to contact clothes stored in the drum and output a different electric signal according to the moisture content of the clothes and a sensor (not shown) which is provided in the duct 7 and senses the temperature of air discharged from the tub. As the drying step S10 and S20 progresses, the dryness level of the clothes may increase (the moisture content of the clothes may decrease) and less heat may be exchanged between hot air supplied into the tub and the clothes (the temperature of the air discharged from the tub may rise). Therefore, the controller may determine whether the dryness level of the clothes has reached the reference dryness level by comparing an electrical signal provided by each sensor with a predetermined reference value.

Upon completion of the drying step S10 and S20, a circulation termination step S41 is performed to terminate the operation of the fan 8. In the circulation termination step S41, the controller terminates the rotation of the impeller 81 by blocking power supply from the fan motor 83.

When the fan 8 stops its operation in the circulation termination step S41, the retrieval step S43 is performed in the control method according to an embodiment of the present invention. The retrieval step S43 includes a step S431 of closing the refrigerant pipe by controlling the expansion valve 97 by the controller and a step S433 of supplying power to the stator 956 of the compressor 95. As the retrieval step S43 is performed, the refrigerant and lubricant stored in the refrigerant pipe 99 coupled to the expansion valve 97, the evaporator 91, and then the compressor 95 may be retrieved into the chamber 958*a*. Therefore, the control method according to an embodiment of the present invention may minimize the amount of residual lubricant in the refrigerant pipe by the retrieval step, thereby preventing shortage of the lubricant in the compressor 95.

The reason for starting the retrieval step S43 after the circulation termination step S41 of terminating the operation of the fan 8 is that unless heat is exchanged with air by the heat pump, to terminate the operation of the fan and retrieve the lubricant in the retrieval step S43 is favorable in terms of energy saving.

With the refrigerant pipe 99 closed by the expansion valve 97, the retrieval step S43 is performed. Therefore, a high RPM of the compression unit 9553 may cause an increase in the internal pressure of the refrigerant pipe 99 that couples the compressor 95, the condenser 93, and the expansion valve 97 to one another. To minimize the problem, the RPM of the compression unit 9553 may be set to be lower in the retrieval step S43 than in the heat exchange step S23. If the compressor 95 is a reciprocating compressor, the reciprocating cycle of the compression unit 9553 may be set to be longer in the retrieval step S43 than in the heat exchange step S23.

Upon completion of the retrieval step S43, the operation of the compressor 95 is terminated in step S45 and then the cooling step S47 is performed in the control method according to an embodiment of the present invention. In step S45, the operation of the compressor 95 is terminated by blocking power supply from the stator 956 of the compressor 95 by the controller. The cooling step S47 is a process of preventing occurrence of an unexpected incident when the user takes out the clothes from the drum by dropping the temperatures of the clothes and the container 2. In the cooling step S47, the controller rotates the impeller 81 for a predetermined cooling time by supplying power to the fan motor 83.

The control method according to an embodiment of the present invention may further include the step S30 of periodically determining whether the filter 217 needs cleaning during the drying step S10 and S20 in progress. If a large amount of foreign material remains in the filter 217, less air is introduced into the duct 7 and less hot air is supplied to the clothes, thereby decreasing drying efficiency. The step S30 of determining whether cleaning is needed is intended to avoid this problem.

The step S30 of determining whether the filter needs cleaning may include a residual amount determination step for determining whether the amount of a foreign material remaining in the filter 217 is equal to or larger than a predetermined reference amount.

The residual amount determination step may include a step of determining whether the amount of power supplied to the fan motor 83 to maintain the RPM of the impeller 81 to be a predetermined reference RPM during the circulation step S21 in progress is less than or equal to a predetermined reference amount of power.

If the impeller 81 is controlled to rotate at the reference RPM in the circulation step S21, the load of the impeller 81 decreases (the amount of air introduced into the duct) with the increase of the amount of the foreign material remaining in the filter. Therefore, less power may be supplied to the fan motor 83. Accordingly, if the amount of power supplied to the fan motor 93 is equal to or less than the reference power amount in the residual amount determination step, the controller may determine that the amount of the foreign material remaining in the filter is equal to or larger than the reference amount.

The residual amount determination step may be performed through the pressure sensing unit 27 configured to sense the water level of the tub 21. Since the tub 21 is not perfectly sealed, more of a foreign material remaining in the filter 217 leads to more air supplied to the tub 21 than air discharged from the tub 21, thereby increasing the internal pressure of the tub 21. Accordingly, if a pressure sensed by the pressure sensor 273 of the pressure sensing unit is equal to or higher than a predetermined reference pressure during the hot air supply step S20 in progress, the controller may determine that the amount of a foreign material remaining in the filter is equal to or larger than the reference amount.

Further, if the temperature of the refrigerant discharged from the compressor 95 is equal to or higher than a predetermined reference temperature, the controller may determine that the amount of a foreign material remaining in the filter 217 is equal to or larger than the reference amount in the residual amount determination step. As the amount of the foreign material remaining in the filter 217 increases, the temperature of the refrigerant discharged from the chamber 958*a* tends to rise. Accordingly, the controller may determine that the amount of the foreign material remaining in the filter 217 is equal to or larger than the reference amount by comparing a refrigerant temperature provided by the temperature sensing unit 991 in the outlet 951*b* with the reference temperature.

If the amount of the foreign material remaining in the filter 217 is equal to or larger than the reference amount in the above operation, the procedure goes to a filter cleaning step S33 in the control method according to an embodiment of the present invention. In the filter cleaning step S33, the controller controls the second valve 37 of the filter cleaning unit 35 to spray water onto the filter 217.

However, the filter cleaning step S33 may start after completion of the fan operation termination step S31 of terminating the operation of the fan 8. If the fan 8 is running during the filter cleaning step S33 in progress, a water film may be formed on the surface of the filter 217. The formation of a water film on the filter 217 may give rise to decreased heat exchange efficiency in the hot air supply step S20 which resumes after completion of the filter cleaning step S33.

Further, an interim retrieval step S35 may be performed to retrieve the refrigerant and lubricant from the refrigerant pipe 99 in the middle of the filter cleaning step S33. The interim retrieval step S35 may include a step S351 of closing the refrigerant pipe 99 by controlling the expansion valve 97 and a step S353 of operating the compression unit 9553 by supplying power to the stator 956 of the compressor 95. In the step S353 of operating the compression unit 9553, the RPM of the compression unit 9553 may be set to be lower than in the heat exchange step S23.

To minimize a dry time, a progress time of the interim retrieval step S35 may be set to be equal to or shorter than that of the filter cleaning step S33.

Even though the filter cleaning step S33 starts after completion of the fan operation termination step S31, a water film is likely to be formed on the filter. Therefore, the control method according to an embodiment of the present invention may further include a water film removal step S37 of operating the fan 8 at a high RPM during a predetermined time after completion of the filter cleaning step S33. That is, the RPM of the impeller 81 is set to be higher in the water film removal step S37 than in the circulation step S21.

After the water film removal step S37 is completed, it is determined whether the dryness level has reached the reference dryness level or the progress time of the drying step S10 and S20 has reached a reference time in step S40 in the control method according to an embodiment of the present invention.

If the dryness level of clothes has reached the reference dryness level or the progress time of the drying step S10 and S20 has reached the reference time, the foregoing circulation termination step S41, the retrieval step S43, the compressor operation termination step S45, and the cooling step S47 are sequentially performed in the control method according to an embodiment of the present invention.

However, if the dryness level of the clothes has not reached the reference dryness level or the progress time of the drying step S10 and S20 has not reached the reference time after completion of the water film removal step, the hot air supply step S20 may be resumed in the control method according to an embodiment of the present invention.

While the foregoing embodiment has been described in the context of a clothes treating apparatus capable of both of clothes drying and clothes washing, the control method according to an embodiment of the present invention may also be applied to a clothes treating apparatus designed only for clothes drying. In the case of a clothes treating apparatus designed only for clothes drying, the tub 21 of the container 2 may not be provided. In this case, the duct 7 may be located outside the drum 24 and configured to circulate air inside the drum 24.

Those skilled in the art will appreciate that the present invention may be carried out in other specific ways than those set forth herein without departing from the spirit and essential characteristics of the present invention. The above embodiments are therefore to be construed in all aspects as illustrative and not restrictive. The scope of the invention should be determined by the appended claims and their legal equivalents, not by the above description, and all changes coming within the meaning and equivalency range of the appended claims are intended to be embraced therein.

The invention claimed is:

1. A method of controlling a clothes treating apparatus including a container configured to accommodate clothes therein, a duct forming a passage for circulating air inside the container therethrough, a fan provided in the duct, a refrigerant pipe forming a refrigerant and a lubricant circulation passage, an evaporator configured to evaporate refrigerant by exchanging heat with air, a condenser configured to condense the refrigerant by exchanging heat with air passed through the evaporator, a compressor configured to compress the refrigerant discharged from the evaporator and transferring the compressed refrigerant to the condenser and includes a body which compresses the refrigerant via either rotary or linear reciprocating motion, and an expansion valve configured to open and close the refrigerant pipe, the method comprising:

operating the fan a first time to circulate air through the duct and the container;

opening the expansion valve for a drying step;

operating, for the drying step, the compressor at a first operation speed when the expansion valve is opened for the drying step to circulate the refrigerant through the refrigerant pipe;

performing a determination to determine that a dryness level of clothes stored in the container has reached a predetermined reference dryness level or a reference time has elapsed;

terminating the operating of the fan the first time after the determination that the dryness level of clothes stored in the container has reached the predetermined reference dryness level or the reference time has elapsed;

closing the expansion valve after the terminating the operating of the fan the first time after the determination that the dryness level of clothes stored in the container has reached the predetermined reference dryness level or the reference time has elapsed; and in response to the closing of the expansion valve and while the expansion valve is closed, retrieving the lubricant inside the refrigerant pipe by operating the compressor at a second operation speed lower than the first operation speed, wherein a number of revolutions of the body is configured to be less while the expansion valve is closed for the retrieving of the lubricant than while the expansion valve is opened for the drying step.

2. The method according to claim 1, further comprising:

terminating the operation of the compressor after the operating of the compressor at the second operation speed for the retrieving of the lubricant, and operating the fan a second time during a predetermined time after the terminating of the operation of the compressor for the retrieving of the lubricant.

3. The method according to claim 1, further comprising:

determining that an amount of a foreign material remaining on a filter configured to filter air introduced into the duct is equal to or larger than a predetermined reference amount, during the operating of the fan the first time to circulate air through the duct and the container;

stopping the operating of the fan when the amount of the foreign material remaining on the filter is determined to be equal to or larger than the predetermined reference amount; and operating a filter cleaning unit configured to spray water onto the filter after the stopping the operating of the fan.

4. The method according to claim 3, further comprising:

after the stopping the operating of the fan when the amount of the foreign material remaining on the filter is determined to be equal to or larger than the predetermined reference amount, performing the following:

closing the expansion valve for an interim retrieval step, and retrieving the refrigerant and the lubricant from the refrigerant pipe to the compressor by operating the compressor for the interim retrieval step after the stopping the operating of the fan when the amount of the foreign material remaining on the filter is determined to be equal to or larger than the predetermined reference amount.

5. The method according to claim 4, wherein a length of time of the interim retrieval step is set to be equal to or shorter than a length of time of the operating of the filter cleaning unit.

6. The method according to claim 4, further comprising operating the fan at a higher RPM than the operating of the fan the first time, after the operating of the filter cleaning unit.

7. The method according to claim 3, wherein the fan includes an impeller provided inside the duct and a motor configured to rotate the impeller, and wherein an RPM of the impeller is maintained at a predetermined reference RPM when the fan is operated the first time, and when an amount of current supplied to the motor to maintain the predetermined reference RPM is equal to or less than a reference current amount, the filter cleaner unit is operated.

8. The method according to claim 3, wherein the container includes a tub configured to accommodate water therein and a drum rotatably provided inside the tub and configured to accommodate laundry therein, and wherein in response to a pressure sensed by a pressure sensor configured to sense an internal pressure of the tub is equal to higher than a predetermined reference pressure, the filter cleaner unit is operated.

9. The method according to claim 3, wherein when a temperature of the refrigerant discharged from the compressor is equal to or higher than a predetermined reference temperature, the filter cleaning unit is operated.

* * * * *